US010823530B1

(12) United States Patent
Wilson

(10) Patent No.: US 10,823,530 B1
(45) Date of Patent: Nov. 3, 2020

(54) RETICLE FOR AN OPTICAL GUN SIGHT

(71) Applicant: Barry Wilson, Simpsonville, SC (US)

(72) Inventor: Barry Wilson, Simpsonville, SC (US)

( * ) Notice: Subject to any disclaimer, the term of this patent is extended or adjusted under 35 U.S.C. 154(b) by 0 days.

(21) Appl. No.: 16/133,369

(22) Filed: Sep. 17, 2018

Related U.S. Application Data

(60) Provisional application No. 62/558,922, filed on Sep. 15, 2017.

(51) Int. Cl.
*F41G 1/38* (2006.01)
*F41G 1/12* (2006.01)
*F41G 1/14* (2006.01)

(52) U.S. Cl.
CPC *F41G 1/12* (2013.01); *F41G 1/14* (2013.01)

(58) Field of Classification Search
CPC ..... F41G 1/12; F41G 1/14; F41G 1/38; F41G 1/473; F41G 3/06; F41G 3/08; G02B 23/14
USPC ..... 42/122; 89/41.17; 156/345.24; 235/404, 235/414
See application file for complete search history.

(56) References Cited

U.S. PATENT DOCUMENTS 5,920,995 A * 7/1999 Sammut ..... F41G 1/38 42/122
7,343,707 B2 * 3/2008 Smith, III ..... F41G 1/38 42/122
7,856,750 B2 * 12/2010 Sammut ..... F41G 1/38 42/122
8,365,455 B2 * 2/2013 Davidson ..... F41G 1/38 42/137

FOREIGN PATENT DOCUMENTS

EP 1038149 4/2016

* cited by examiner

*Primary Examiner* — Michael D David
(74) *Attorney, Agent, or Firm* — Bennett Mullinax, LLC

(57) ABSTRACT

A reticle for an optical gun sight is provided having a plurality of vertical reference lines which extend below a horizontal reference line.
The grid pattern of vertical reference lines and horizontal reference lines further provide a pattern of at least five vertical lines which extend below a horizontal reference line to a left side of a vertical center line and a second pattern of at least five reference lines which extend below the horizontal reference line and to a right of a vertical center line.

12 Claims, 7 Drawing Sheets

RETICLE FOR AN OPTICAL GUN SIGHT

RELATED APPLICATIONS

This application claims the benefit of U.S. Application Ser. No. 62/558,922 filed on Sep. 15, 2017 and which is incorporated herein by reference.

FIELD OF THE INVENTION

This invention is directed to telescopic gun sights and a reticle pattern suitable for long-range shooting. The reticle provides an improved grid pattern that allows for a rapid target acquisition using the grid layout which can be utilized in combat situations with minimal needs to perform calculations that are necessary for prior art reticle designs. Further, the reticle allows target adjustments to be made without mechanical adjustments to the gun sight.

BACKGROUND OF THE INVENTION

The present invention relates to telescopic gun sights, and more particularly to reticles for use in telescopic gun sights.

The accuracy and consistency in shooting depends largely upon the skill the shooter and the construction of the fire arm and quality of ammunition.

At very long ranges, environmental, conditions and laws of physics can affect the flight of the bullet and the point of impact down range. Once such factor is "bullet drop" caused by the influence of gravity on the moving bullet. To adjust for bullet drop, it is necessary to elevate the barrel of the weapon and the aiming point to adjust for bullet drop. Other factors such as wind, the magnus effect, bullet design, and various unique properties of the weapon can cause the bullet to drift to the left or right of a central path over long range. Such effects are generally referred to as "windage" effects. Therefore, to hit a target at long range, it may be necessary to correct for windage by moving the barrel of the weapon slightly to the left or right to compensate for bullet drift. Thus, in order to hit the target at long range, the shooter must see the target, accurately estimate the range to the target, estimate the effect of bullet drop, any wind factors, and process this information to properly position of the barrel the firearm prior to squeezing the trigger.

Conventional telescopic gun sights or scopes are not, generally useful at long ranges. The cross hairs of such scope are typically located in the center of the field and modifications to this basic system have not, thus far, enabled a skilled shooter firing at long ranges to acquire and hit a target quickly and reliably. According, there remains room for variation and improvement within the art.

SUMMARY OF THE INVENTION

It is one aspect of at least one of the present embodiments of the invention to provide for an improved telescopic gun sight useful with a conventional optical scope in which the scope is modified with the reticle as described herein.

It is another aspect of at least one embodiment of the present invention to provide an improved and less cluttered field of view of a reticle pattern for placement in a telescopic optical sight. The placement can either be etched in glass, use a projection system, or use a non-etched applied marking such as a sticker or decal.

It is another aspect of at least one embodiment of the present invention is to provide a reticle for use in a telescopic gun sight and a method of using comprising:

a horizontal reference line;

a vertical reference line, the vertical reference line intersecting at a right angle with the horizontal reference line;

a first pattern of at least five vertical lines extending beneath the horizontal reference line and to a left of the vertical reference line, each of said at least five vertical lines positioned an equal distance from any adjacent line forming the first pattern;

a second pattern of at least five reference lines which extend beneath the horizontal reference line and extend to a right of the vertical reference line, each of said at least five vertical lines defining the second pattern positioned an equal distance from any adjacent line forming said second pattern of lines;

wherein of each of said first pattern and each of said second pattern of reference lines further define a plurality of tick marks or lines having a common length and position from an edge of the respective vertical lines of said first and said second patterns and positioned a fixed distance apart; and wherein of said first and said second pattern of reference lines further define a plurality of horizontal lines which are spaced between the tick marks and are bisected by the respective reference lines.

It is another aspect of at least one embodiment of the present invention is to provide reticle pattern for an optical sight consisting of a reticle for use in a telescopic gun sight comprising:

a horizontal reference line;

a vertical reference line, the vertical reference line intersecting at a right angle with the horizontal reference line;

a first pattern of at least five vertical lines extending beneath the horizontal reference line and to a left of the vertical reference line, each of said at least five vertical lines positioned an equal distance from any adjacent line forming the first pattern;

a second pattern of at least five reference lines which extend beneath the horizontal reference line and extend to a right of the vertical reference line, each of said at least five vertical lines defining the second pattern positioned an equal distance from any adjacent line forming said second pattern of lines;

wherein of each of said first pattern and each of said second pattern of reference lines further define a plurality of tick marks or lines having a common length and position from an edge of the respective vertical lines of said first and said second patterns and positioned a fixed distance apart; and wherein of said first and said second pattern of reference lines further define a plurality of horizontal lines which are spaced between the tick marks and are bisected by the respective reference lines.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

European Patent EP 1038149B1, U.S. Pat. Nos. 8,365,455, 5,920,995, and 7,343,707 are all incorporated herein by reference in their entirety and provide teachings which include the construction of optical sights, reticles, and the use of reticles in acquiring a target which compensate for wind, bullet drop, and other environmental conditions such as ambient temperature, humidity, and surface reflected radiation/convection.

An improved reticle for an optical sight is provided which facilitates the rapid acquisition of a target that allows for correction of lateral drift as well as compensating for vertical bullet drop. The reticle design as set forth herein provides for an improved grid system that allows for rapid target acquisition. A fully enabling disclosure to one of ordinary skill in the art is further provided by the Figures, the written specification including the references incorporated therein by reference, and the claims of the present application.

Figure 1:
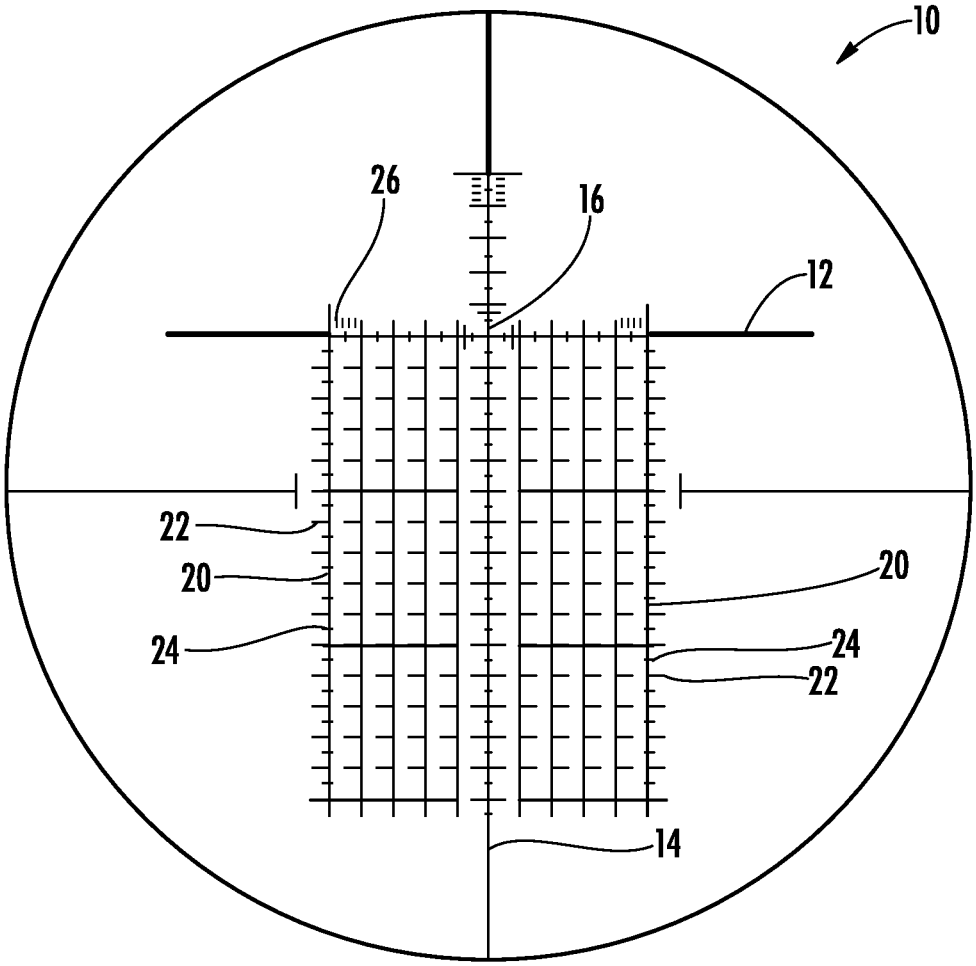
FIG. 1 is a first embodiment of a reticle according to the present invention.

As set forth in FIG. 1 a first embodiment of a reticle according to the present invention is shown. The reticle 10 comprises a horizontal cross hair 12, a vertical cross hair 14, which intersect at a location 16 that is typically used to "zero in" a specified target at a known distance. As further seen in reference to FIG. 1, below the horizontal line 12 there extends a series of additional vertical lines 20 on either side of reticle line 14 and extending downwardly from the horizontal line 12. In the example shown, there are a series of five vertical lines on either side of the vertical line 14 and which further define a plurality of tic marks in a specified known distance. As seen in the figures, the left and right edges of horizontal line 12 can have an increased thickness or height to help low light visualization as does the upper portion of vertical line 14.

In the embodiment illustrated in FIG. 1, the grid pattern is divided into tic marks of mil or milradian and ½ mil or milradian increments. This particular reticle design maintains open areas along the top, sides and bottom of the reticle pattern and facilitates the instant hold for aiming and for trajectory calculations for any bullet path. The top horizontal line has similar markings 24 with additional ticks or markings 26 at increments of 0.2, 0.4, 0.6, and 0.8 mil vertical spacing between vertical lines 20.

The main vertical line 14 additionally has incremental tick marks or lines 28 that allow for height of target adjustment to the closest 1/10 mil to help in range determination. The mil formula is typically used within military scopes. The mil formula is as follows:

For a dedicated weapon system (DWS) using a standardized caliber, barrel length, and specified ammunition such as a 7.62 millimeter or 5.56 millimeter or a .300 Windchester Magnum®, a ballistic bullet drop choke gauge 36 for width of E-target is matched with the mil hold impact at each range and is fitted along the central vertical cross hair. The left side of the observed target is placed against the central vertical and a series of left pointing chevrons are used to find width and when the chevron fits at the right side of the observed target it gives one the correct range and impact of the round at that same range at the same time. The user then adjusts the center of the target on the main vertical at center mass for that mil-hold for proper targeting and firing. No charts are needed, no math, and no calculations.

In the embodiment as seen in FIG. 1, the 1 mil markings reflect 3.6 at 100 yards or 3.9 inches at 100 meters.

Figure 2:
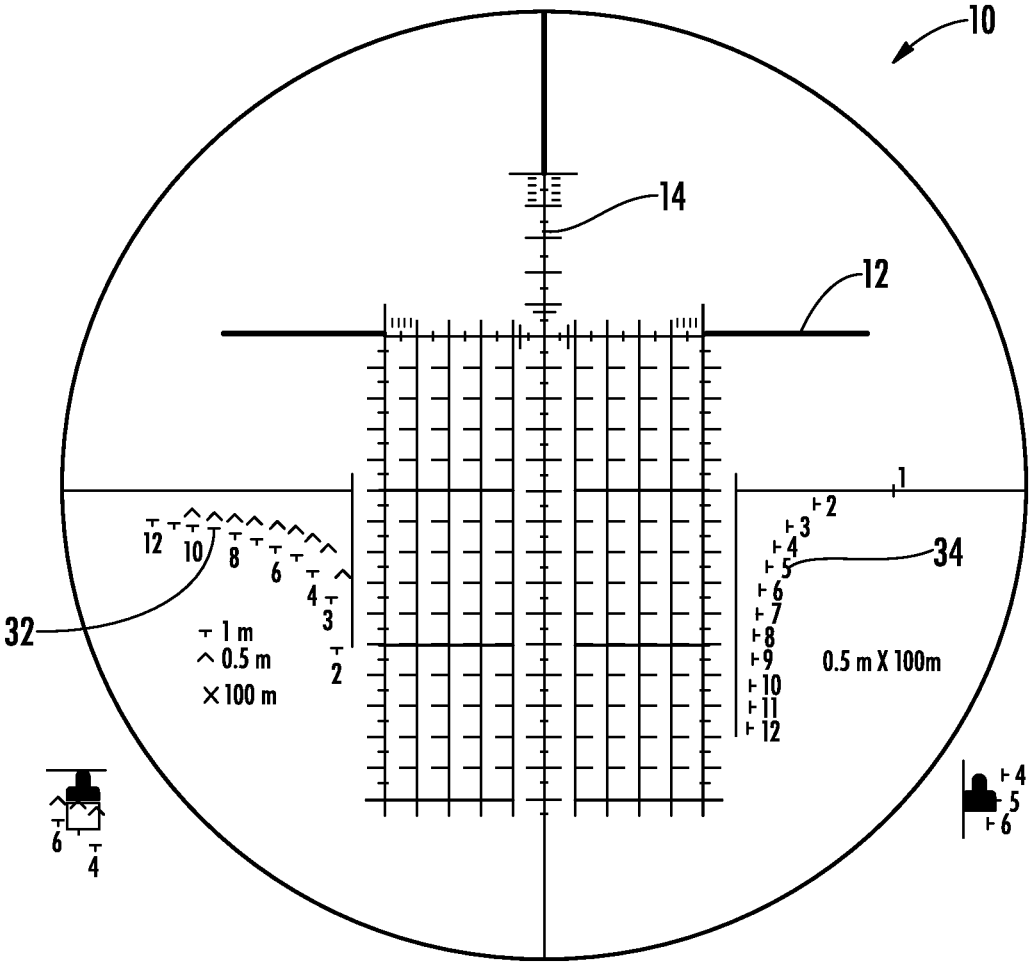
FIG. 2 is an alternative embodiment similar to FIG. 1 showing additional details of the invention.

As seen in FIG. 2, a similar reticle layout to that of FIG. 1 is provided with additional optional markings seen in the left and right bottom quadrants, a range finder choke gauge that can range from 2 to 12 can be set forth on respective opposite sides of the main reticle pattern. This allows for rapid range finding using the left side gauge 32 for height and the right side gauge 34 for width.

One advantage of the reticle patterns as seen in the embodiments of FIG. 1 and FIG. 2, as well as the additional embodiments set forth below, is that the reticle pattern provides the complete functional information needed for vertical and horizontal sight adjustments yet does so in a pattern that avoids too much clutter from excessive information, excessive number of grid lines present in many prior art scopes. Additionally, as seen in reference to FIG. 1 and FIG. 2, the upper region of the scope above the horizontal line 12 is free of distracting grid lines with respect to the left and the right sides of horizontal line 12. In instances where the magnification of the scope is reduced, the "collapse" of the reticle pattern into a smaller region of the scope sight still provides, for useful information and can be discerned by the user. Many prior art reticle patterns are so crowded that on low magnification, the reticle pattern completely obscures the intended target.

Figure 3:
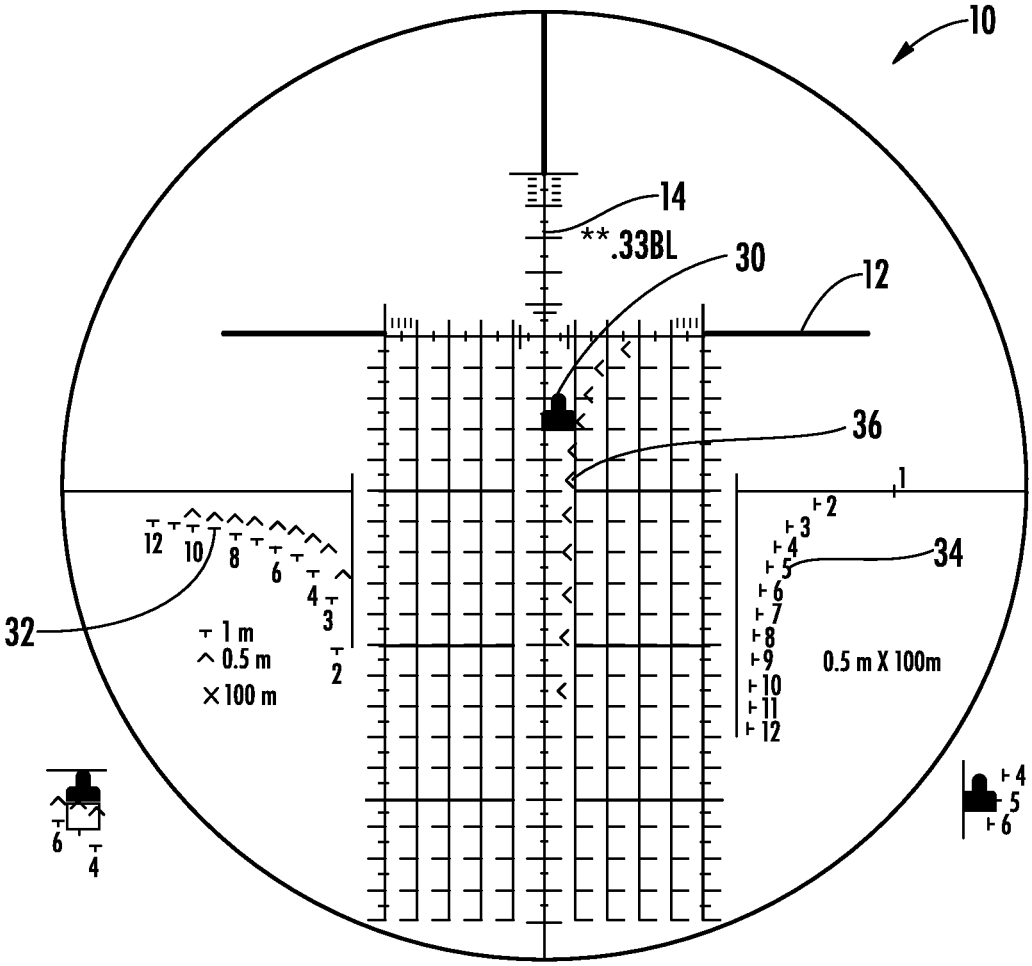
FIG. 3 is an alternative embodiment setting forth additional details on the apparatus and use of the reticle.

As seen in reference to FIG. 3, an embodiment similar to FIG. 2 is added which illustrates a torso 30 which represents a known target dimension that allows for accurate placement and adjustment of the reticle grid pattern to a desired target location within the reticle.

Figure 4A:
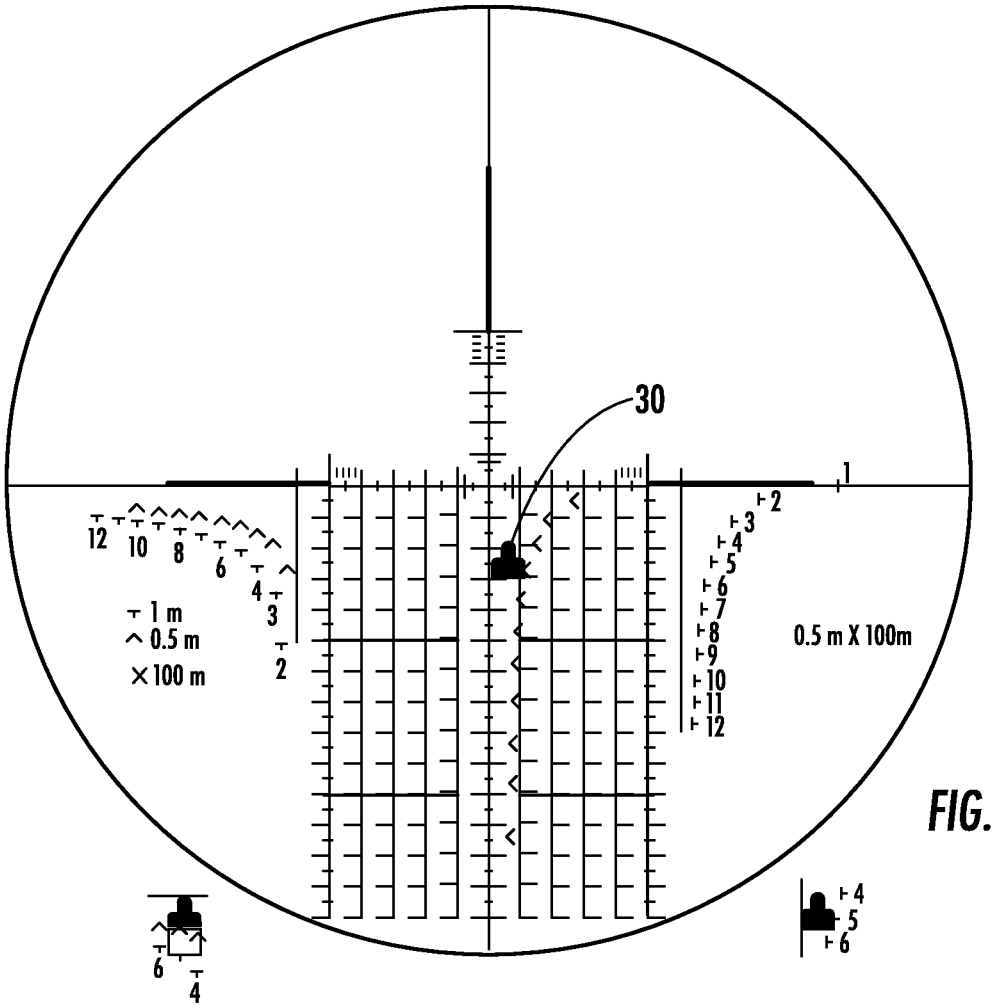
FIGS. 4A and 4B is an alternative embodiment setting forth additional details on the apparatus and use of the reticle.
Figure 4B:
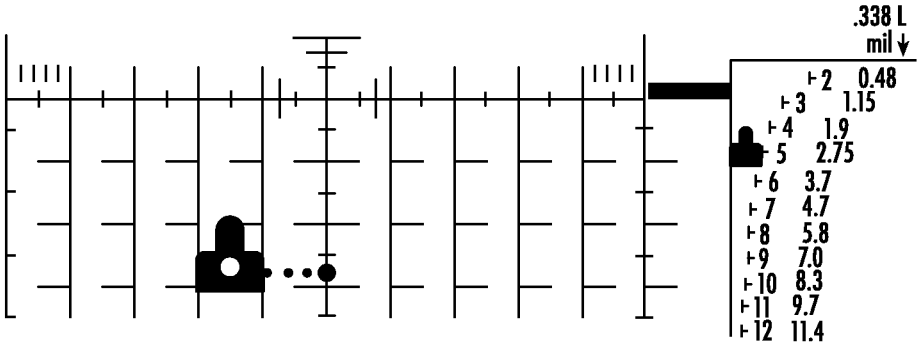

As seen in reference to FIGS. 4A and 4B, a specific reticle pattern portion is set forth which is directed to a customized 0.338 Lapua, at a 500 meter range with a 2.75 mil adjustment vertically and a lateral wind adjustment of horizontal of 1.5 mils. The indicated reticle pattern may be specific for the exact weapon, barrel length, and ammunition to allow for greater precision and accuracy by a marksman.

Figure 5:
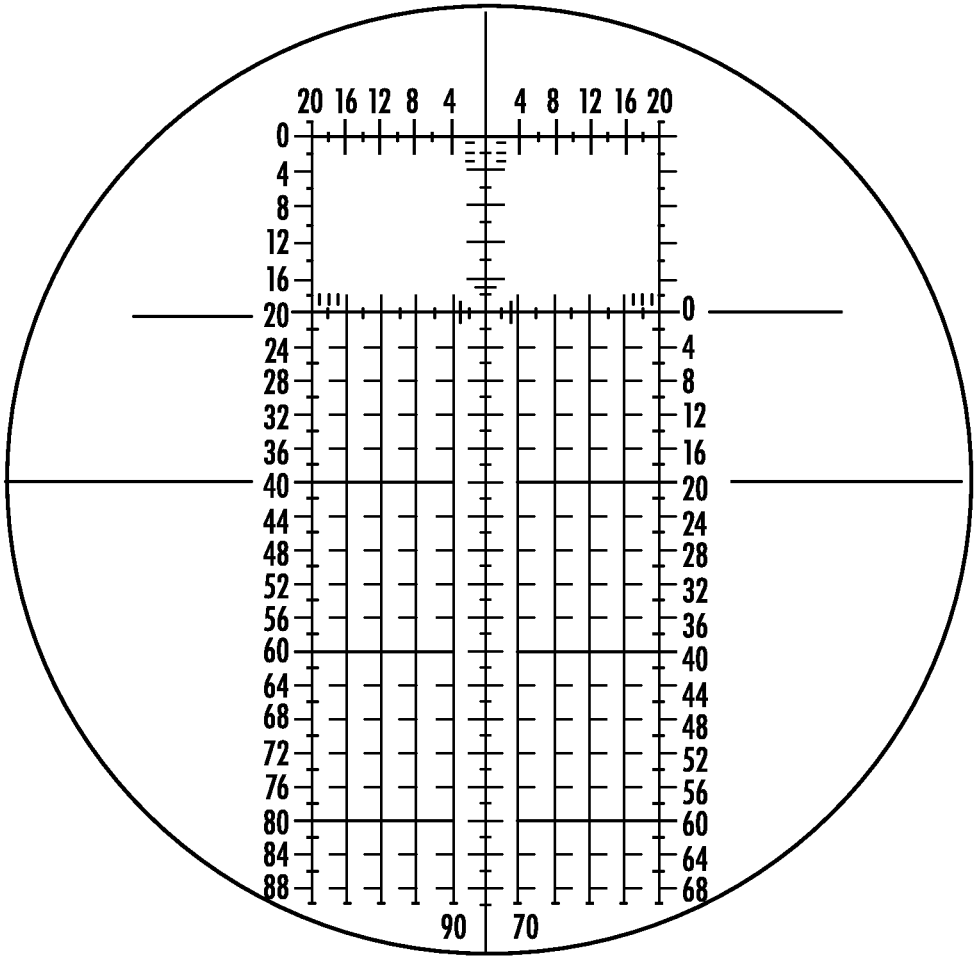
FIG. 5 is an alternative embodiment of the reticle of the present invention showing grid lines in different units of measurement.

FIG. 5 is an alternative embodiment of a reticle pattern in which the vertical and horizontal grid markings are set forth in a 4 minute of angle (MOA) pattern. Again, additional tick marks are provided in a minimally obtrusive manner so as to preserve the overall ability of the reticle in scope to provide for clarity of vision even when the magnification of the scope may change. This is particularly important with respect to battlefield conditions where one may need to adjust quickly to enemy fire and be, able to sight through the scope motion or hostile forces. A crowded scope environment tends to obscure the vision and can impair a shooter's ability to respond to enemy fire or locations.

Figure 6A:
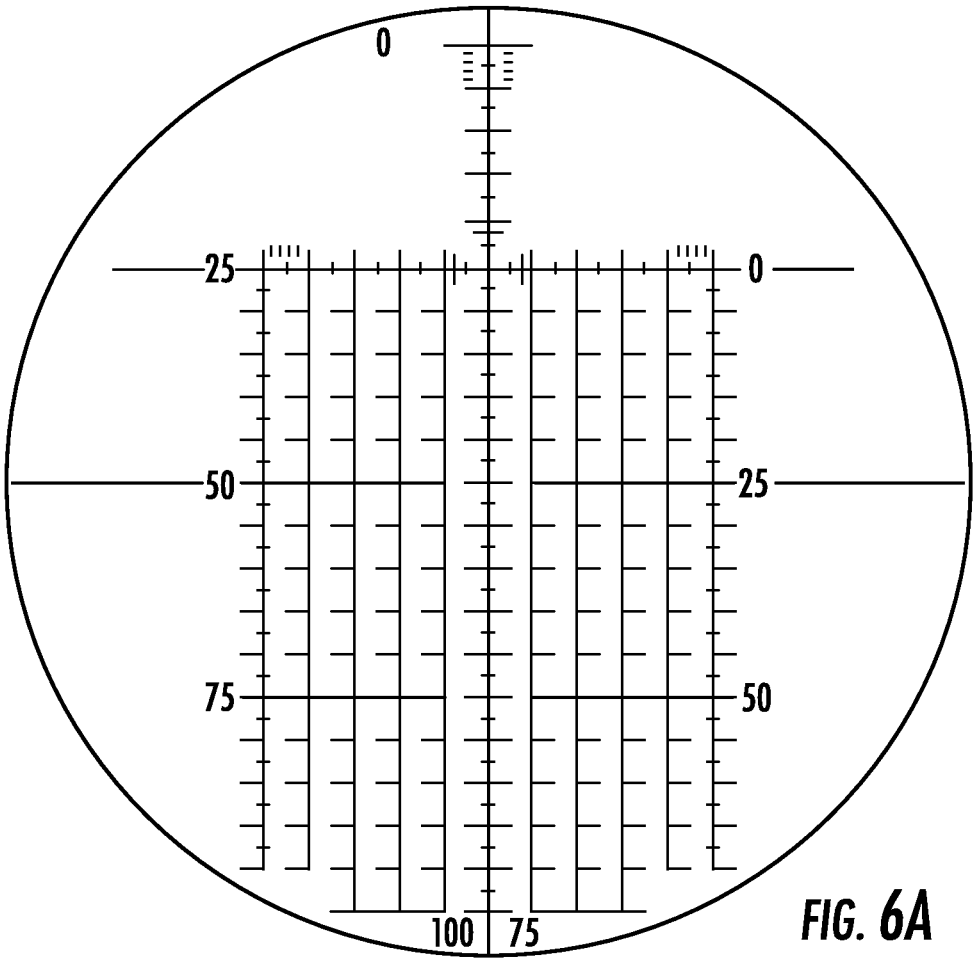
FIG. 6A and FIG. 6B is an alternative embodiment similar to FIG. 5 showing an additional grid layout and units of measurements for the day reticle.
Figure 6B:
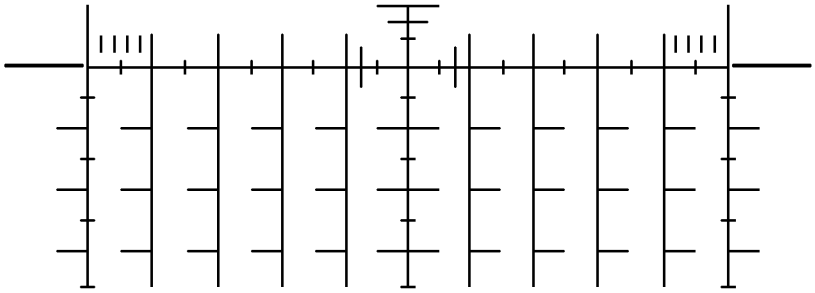

An additional embodiment of the invention as seen in reference to FIGS. 6A and 6B showing additional and alternative grid markings with respect to using a 5 minute of angle (MOA) grid pattern. As seen in reference to FIG. 6B even when magnified, the grid pattern allows for rapid adjustments and positioning of the gun relative to an acquired target with adjustments for vertical drop and horizontal windage.

Figure 7A:
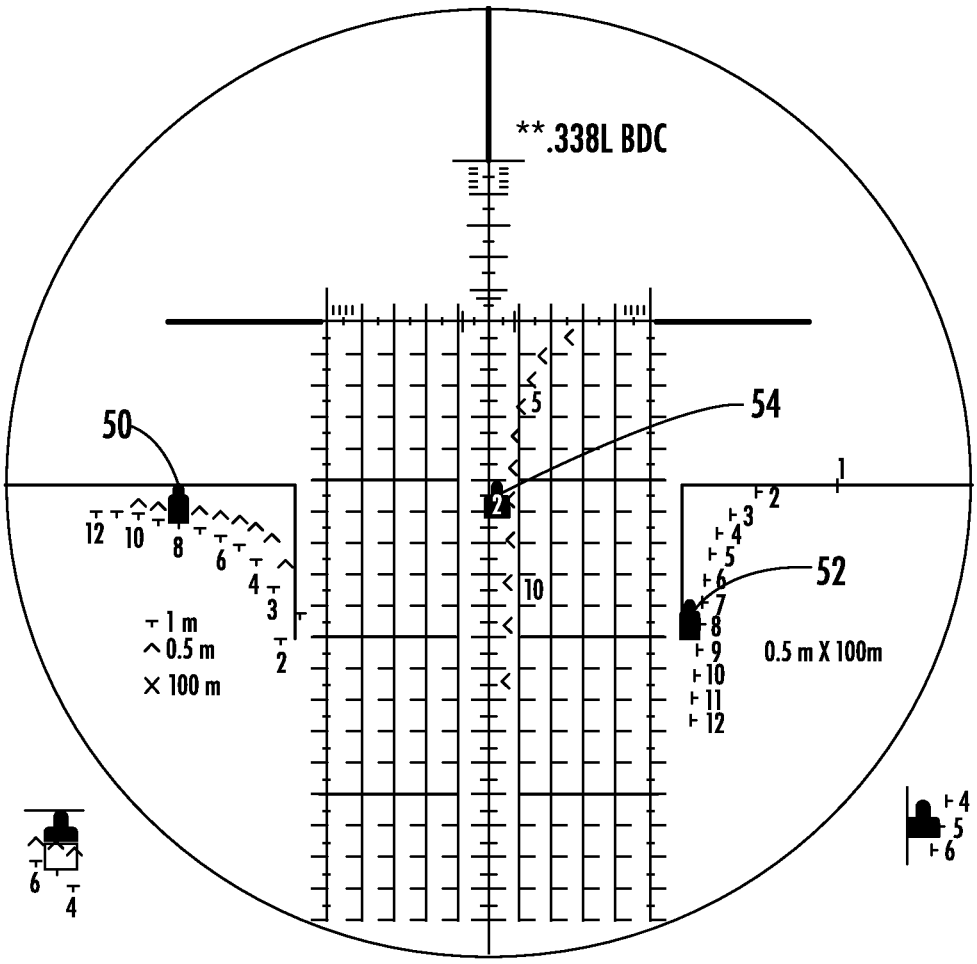
FIGS. 7A and 7B is an alternate embodiment similar to FIG. 6 with a modified grid and units of measurement for the reticle.
Figure 7B:
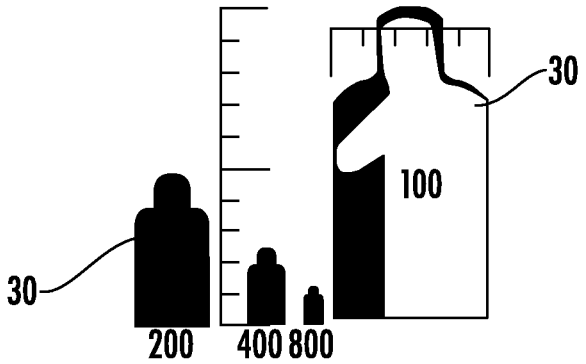

As seen in reference to FIGS. 7A and 7B a customized reticle pattern in accordance to this invention is provided. As seen in reference to FIG. 7A, a human shaped target silhouette 30 can be provided in one or more locations within the reticle. The image 30 is of a known size at an equilibrated distance and allows for rapid adjustments and sightings based upon distance and windage calculations.

FIG. 7B illustrates a height gauge (50) and width gauge (52) and aiming point 54 and which is ammunition specific.

As seen in reference to FIG. 7B, the difference in the silhouette image 30 as seen in reference to various distances of 100, 200, 400, and 800 meters.

The optional bullet drop choke patterns on the left and right lower quadrants are also provided. The particular reticle pattern illustrated is designed for a .338 Lapua with a 7.62 millimeter bore diameter. It is equally possible to customize a reticle pattern for other weapons such as a 5.56 mm (M16) or 7.62 mm (Nato).

The embodiments illustrated above are preferably used with a front or first focal plane optical sight. The grid could also be lowered to center filed of view instead of 5 mils above, with 5.56 mm and 7.62 mm weapons.

One advantage of the reticle system is that it allows both short and long range shooting using an etched glass, decal, or, projected grid reticle without having to use a windage or elevation adjustment knobs on the scope. By way of example, a scope with the reticle pattern of the present invention, once zeroed in to a point of aim, simplifies the calculation and use of mil-angle grid units which may include units used for military purposes in terms of minute of angle (MOA) units or units expressed in mils.

The scope's adjustment knobs may be calibrated for either system to use the grid system. For instance, one grid pattern can have markings in 0.1 millimeters per click of adjustments in terms of both lateral windage adjustments and vertical elevation adjustments. In examples where the grid is expressed in MOA units, the optical reticle pattern can be used with click adjustments for windage and elevation in ¼ MOA or ½ MOA per click. With the rifle zeroed in at the main horizontal cross hair, the optical center of view provides for ½ mil tick marks to allow for descending movement down the reticle, as range increases, on the main vertical and central cross hair. The grid is specifically built to allow for wind drift effects at range by having vertical lines, each one 1 mil apart, with ½ mil flags or cross hairs, in the direction of the wind on both sides of the main vertical reticle marker.

This arrangement allows for the mil cross hairs and mil tick marks to provide for precise holds. The grid is specifically designed to allow for wind drift, effects on both sides of the main reticle with the tick marks still remaining close to the optical center without "bottoming out" in the lowest field of view.

The vertical grid with the wind direction marks provide 5 mils right to left which allows for rapid acquiring of a target due to the elimination of stacked horizontal cross hairs as is commonly used in conventional reticles. The "decluttering" of the reticle view greatly opens up vision through the reticle, reducing the obstruction of view of threats which might be located behind the grid and obscured by the multitude of grid lines in certain prior art designs. This is especially helpful at the lower power settings on variable power scopes with a front focal plane reticle location. The front focal location, being needed to range accurately at any power, will shrink in size and tighten the grid at lower power and, correspondily, expands the grid at higher powers of magnification. At lower power magnifications, the reticle described herein still provides a very clean and open viewing pattern that can be utilized and will not block or obscure needed details such as hostile personnel or dangers that can be viewed in the background.

The grid also features an instant hold-awareness by having the solid lines laying over the wind flags on the $5^{th}$, $10^{th}$ and $15^{th}$ mil positions and can extend every 5 mils as needed. This feature reduces the chance of a wrong line hold by seeing clearly the count and avoiding too much optical clutter and tangle when wind hold-offs are needed or when panning the rifle with respect to moving targets.

For precise mil-measuring of height and width of targets, the respective tick marks are present at each end of the top main horizontal cross hair (between the 5 mil long black bars) with tick marks at 0.2, 0.4, 0.6 and 0.8 mils between the last outside mil for width sizing, to the closest .1 mil for targets in the same top mil, for closest .1 mil of target height.

Once height and width are measured to the closest .1 mil, the range to target can be determined by plugging into the mil formula. The mil formula is as, follows:

The known height or width of the target in meters or yards can be multiplied by 1,000 and then divided by the mil size of the target as seen in the scope. This value equals the range to target in the appropriate units of measure.

One example in reference to the US Army's "E" target (head to torso) is 1 meter high by 0.5 meters wide. The known height of 1 meter times 1,000 divided by the measured seen height of the target through the scope. For example, 2.5 mils, equals a range of 400 meters times 1,000 divided by 2.5 or 1,000 divided by 2.5 equals 500 meters range.

Known width is 0.5 meters times 1,000 divided by the measured seen width of the target through the scope, such as 1.25 mils, equals a range of 400 meters. The calculation of 0.5 times 1,000 divided by 1.25 or 500 divided by 1.25 equals a 400 meter range.

Once this range of target is determined, the trajectory of the particular bullet and bullet drop attributable to gravity for 400 meters is, for example 2.2 mils below the zero point, so for a hold of center mass target at 2.2 mils, figuring a level shot with no wind observed.

With a high number of hostile threats firing at multiple ranges, the need to range and engage rapidly to reduce hostile threats is vital. The E3LR Military RF has military range finders added on each side of the grid body as best seen in reference to the Figures. The left side scale will measure height of targets from 200 meters to 1200 meters with bracketed size marked from 2 to 12 for a known 1 meter height target. The upward pointing chevrons in between the brackets from to the top flat line measure 0.5 meter height target, ½ height E-target (prone shooter).

The range finder (RF) scale on the right side of the grid body measures the width of the target from 200 to 1200 meters in reference to a known 0.5 meter target width, in this case E-target width/

These RF scales greatly enhance the speed of range determination by placing observed threats quickly in height scale and width scale and then using the correct mil-hold over for that range from the prior engagement position of the scope. There are charts that can be utilized for the mil-hold for each range recorded from prior shooting and such charts of mil-hold impacts can be placed on a rifle stock of a weapon or made available on a laminated card. This system allows for quick training and understanding use of the reticle scope and rifle by non-sniper personnel in using the range finder scales to range impact which requires no formulas or calculations which can be an advantage in a heavy multi-targeted attack in which multiple range shots are needed with little time to do calculations as required by other conventional reticle formats.

For a dedicated weapon system using a standard caliber, barrel length, and specified ammunition, a ballistic drop choke drop gauge for width of target be matched with the mil-hold at each range and is fitted along the central vertical cross hair. The left side of the observed target is placed against the central vertical and a series of left pointing chevrons are used to find width when the chevron fits at the right-side of the observed target. This arrangement gives you the correct range and impact at that range simultaneously. Accordingly, the user merely needs to place a center of the target on the main vertical at center mass for that mil-hold without having to refer to charts or perform any mathematical calculations.

Full capability of the reticle allows for an increased reaction in terms of ranging and engagement of any new targets. This is particularly useful when a scope is matched to a particular caliber rifle, length of rifle barrel and tied to specific ammunition. For any given caliber weapon, the reticle allows for an improved grid system that provides for more rapid determination of a firing solution for the range determined. The reticle, tied to a specific rifle, barrel, and ammunition combination allows for an uncluttered field of view, rapid site adjustments to be made by the sniper or spotter, and avoids a cluttered optical field that can mask threats or have such a multitude of grid lines and content that use of the reticle by a shooter is made more difficult.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, both in whole, or in part. Therefore, the spirit and scope of the invention should not be limited to the description of the preferred versions contained therein.

That which is claimed:

1. A reticle for use in a telescopic optical gun sight comprising:

a grid pattern comprising five vertical main lines on a left side of a central axis and five vertical main lines on a right side of the central axis, each vertical main line being marked with a grid pattern selected from the group consisting of millimeters markings, half-millimeter markings, minute of angle markings, and combinations thereof;

a visible horizontal reference line bisecting the optical sight;

wherein, the grid pattern has a vertical height, the majority of the vertical height of the grid pattern extending below the horizontal reference line and the grid pattern is positioned within an optical viewing area thereby providing substantially unobstructed views adjacent a left side and a right side of the optical viewing area.

2. The reticle according to claim 1 wherein said reticle further defines a width scale bullet drop choke reference guide, a portion of which extends along a midline of a vertical axis of the reticle.

3. A grid pattern for use in a telescopic optical gun sight comprising:

a horizontal reference line;

a vertical reference line, the vertical reference line intersecting at a right angle with the horizontal reference line;

a first pattern of at least five vertical lines extending beneath the horizontal reference line and to a left of the vertical reference line, each of said at least five vertical lines positioned an equal distance from any adjacent line forming the first pattern;

a second pattern of at least five vertical reference lines which extend beneath the horizontal reference line and extend to a right of the vertical reference line, each of said at least five vertical lines defining the second pattern positioned an equal distance from any adjacent line forming said second pattern of lines;

wherein of each of said first pattern and each of said second pattern of reference lines further define a plurality of tick marks having a common length and are each positioned from an edge of the respective vertical lines of said first and said second patterns and further positioned a fixed distance apart; and wherein of said first and said second pattern of reference lines further define a plurality of horizontal lines which are spaced between the tick marks and are bisected by the respective reference lines and wherein the grid pattern is positioned with an optical viewing area thereby providing substantially unobstructed views adjacent the first pattern of at least five vertical lines and adjacent the second pattern of a least five vertical reference lines, the grid pattern further having a vertical height, the majority of the grid pattern vertical height extending below the horizontal reference line.

4. The reticle according to claim 3 wherein the first pattern of lines and said second pattern of lines are calibrated with mil angle units of measurement.

5. The reticle according to claim 3 wherein said first pattern lines and said second pattern of lines are calibrated with minute of angle units of measurement.

6. The reticle according, to claim 3 wherein the intersection of the vertical reference line and the horizontal reference line is at a mid-point of the circle defined by the scope optic.

7. The reticle according to claim 3 wherein the intersection of the vertical reference line with the horizontal reference line is positioned in an upper half of the scope optic.

8. The reticle according to claim 7 wherein the intersection of the vertical reference line and the intersection of the horizontal reference line is positioned between a mid-point of the scope optic and an upper edge of the scope optic.

9. The scope optic according to claim 3 wherein the lower half of the scope field of view further defines at least one choke gauge to indicate target height or target width.

10. The scope optic according to claim 9 wherein a choke pattern is present along both a left lower quadrant and a right lower quadrant of the scope optic.

11. The reticle according to claim 3 wherein the reticle further defines a chevron choke pattern along the central vertical axis that is customized for a specific caliber, gun barrel, and ammunition source.

12. The reticle according to claim 3 wherein the reticle is applied to the optical gun sight via engraving, a decal, or an optical projection.

* * * * *